United States Patent [19]

Ketler et al.

[11] 3,953,725

[45] Apr. 27, 1976

[54] ILLUMINATING APPARATUS

[75] Inventors: Albert E. Ketler, Indiana; Ronald P. Campbell, Latrobe; George Shacreaw, Blairsville, all of Pa.

[73] Assignee: Ocean Energy, Inc., Blairsville, Pa.

[22] Filed: Apr. 22, 1974

[21] Appl. No.: 462,886

[52] U.S. Cl. ..... 240/51.11 R; 240/46.33; 240/60; 240/103 R; 339/50 R

[51] Int. Cl.[2] ..... H05B 33/02

[58] Field of Search ..... 240/51.11 R, 103 R, 240/103 E, 47, 46.39, 11.4, 11.2 E, 6, 46.33; 339/50

[56] References Cited

UNITED STATES PATENTS

| | | | |
|---|---|---|---|
| 1,219,389 | 3/1917 | Griggs et al. | 240/46.39 |
| 1,336,951 | 4/1920 | Fuligni et al. | 240/46.39 |
| 1,618,010 | 2/1927 | Hoss | 240/46.39 |
| 2,323,073 | 6/1943 | Netting | 240/103 B |
| 2,745,001 | 5/1956 | Guth | 240/78 LD |
| 2,888,657 | 5/1959 | Green | 240/11.4 R X |
| 3,265,804 | 8/1966 | Berger et al. | 240/106 R X |
| 3,377,473 | 4/1968 | Breding et al. | 240/47 X |
| 3,609,337 | 9/1971 | Adra | 240/103 B X |
| 3,673,401 | 6/1972 | Du Pont | 240/11.2 E X |
| 3,751,653 | 8/1973 | Henry | 240/6 |
| 3,786,247 | 1/1974 | Eilert | 240/47 |

FOREIGN PATENTS OR APPLICATIONS

| | | | |
|---|---|---|---|
| 6,606,394 | 11/1967 | Netherlands | 240/47 |
| 550,434 | 12/1922 | France | 240/46.33 |
| 166,394 | 1/1950 | Germany | 240/11.2 E |
| 89,636 | 12/1958 | Netherlands | 240/11.2 E |

*Primary Examiner*—Richard M. Sheer
*Attorney, Agent, or Firm*—Michael Williams

[57] ABSTRACT

The invention relates broadly to a fluorescent lamp construction adapted for use with hats or caps worn by workers in various occupations. The so-called hard hats are now largely worn by workers in hazardous locations, such as mining, construction, service and the like, and our improved fluorescent lamp construction is especially suited for attachment to a hard hat and the invention includes new and novel connection means.

The fluorescent lamp is contained within an oblong housing that is removably held horizontally at the front of the hard hat and the lamp is energized by a battery which is carried on the person of the worker, such as by means of a carrying case having a clip for connecting it to a belt worn by the worker.

To achieve a high level of light output at low temperatures, the invention includes means for conserving heat generated by the fluorescent lamp. Also, to reduce glare, the invention includes a new and novel means for dispersing the light from the lamp.

6 Claims, 14 Drawing Figures

ILLUMINATING APPARATUS

BACKGROUND AND SUMMARY

Insofar as we are aware, the prior art in cap lamps is largely limited to the incandescent bulb type, commonly worn by persons working underground in mines. Standard lamps of this type consume about four watts of power and produce about fifty lumens projected like a flashlight in a narrow beam. In an attempt to enlarge the beam size, such lamps have been defocused so that the spot size diverges to a larger ring, but the light intensity then becomes lower.

In the black regions of a coal mine with wall emisitivity ranging from 1 to 4%, considerably more light is required to work safely. Roof bolts projecting down from the ceiling, trolley tracks and holes in the floor, pillars, roof support posts, and the myriad obstructions in coal mines are difficult to see with the present cap lamp, and the miner is required to continually move his head in a scanning fashion to identify obstructions which could be hazardous. Although these problems are commonly known in mining operations, similar problems are also present in other operations, such as in construction, service and the like.

In our improved fluorescent lamp construction, the lamp operates at a power level of about four watts, but the light output is approximately three hundred lumens. Although the light does not focus in a narrow spot, the great increase in light output, as compared with the incandescent bulb type, makes this a significant improvement in visability and, therefore, safety for the workman. Because of the lateral length of the fluorescent lamp, and the reflector associated therewith, the resulting light pattern is horizontal and quite wide, so that the workman may easily view a fairly wide expanse in front of him, without moving his head side-to-side or up and down.

DESCRIPTION OF THE DRAWINGS

In the drawings accompanying this specification and forming a part of this application, there are shown, for purposes of illustration, several embodiments which our invention may assume, and in these drawings.

DESCRIPTION OF PREFERRED EMBODIMENT

Figures 1, 13, 14:
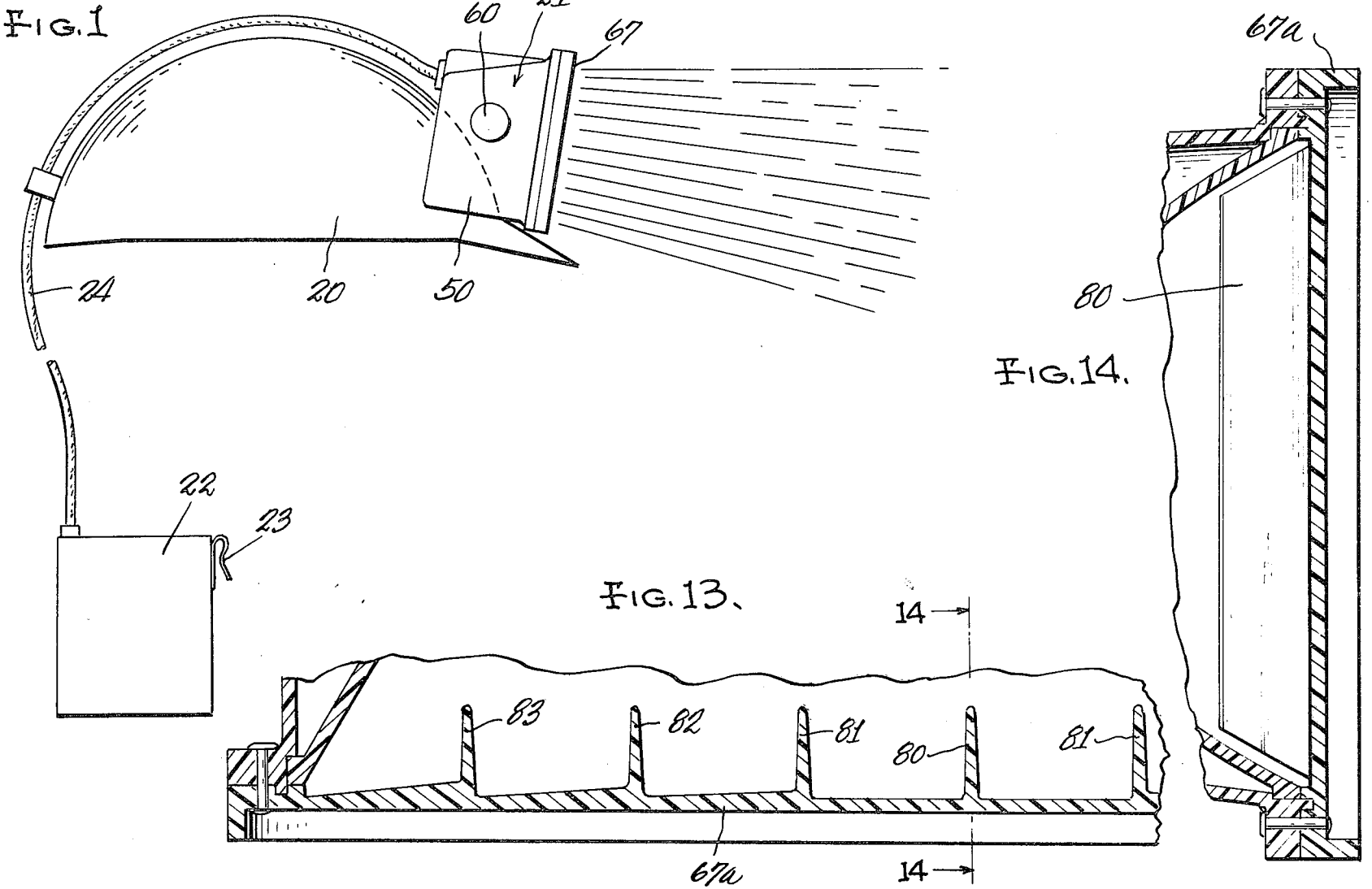
FIG. 1 is a small scale, side elevational view of the improved lamp connected to a hard hat, and a battery adapted to energize the same.
FIG. 13 is a fragmentary, sectional view, illustrating another embodiment for reducing side glare from the lamp.
FIG. 14 is a fragmentary sectional view corresponding to the line 14—14 of FIG. 13.

As seen in FIG. 1, our improved cap lamp is adapted for connection to the forward portion of a hard hat 20, and comprises an oblong housing 21 which is preferably disposed horizontally, as shown. The lamp receives power from a rechargeable battery 22 which has a clip 23 so that it may be suspended from a belt (not shown) worn by a workman. A power cord 24 extends from the battery to the housing 21 and for safety purposes, especially in mining operations, the cord and its connection are sealed to minimize sparking.

Figures 2, 3, 8, 9, 10, 11, 12:
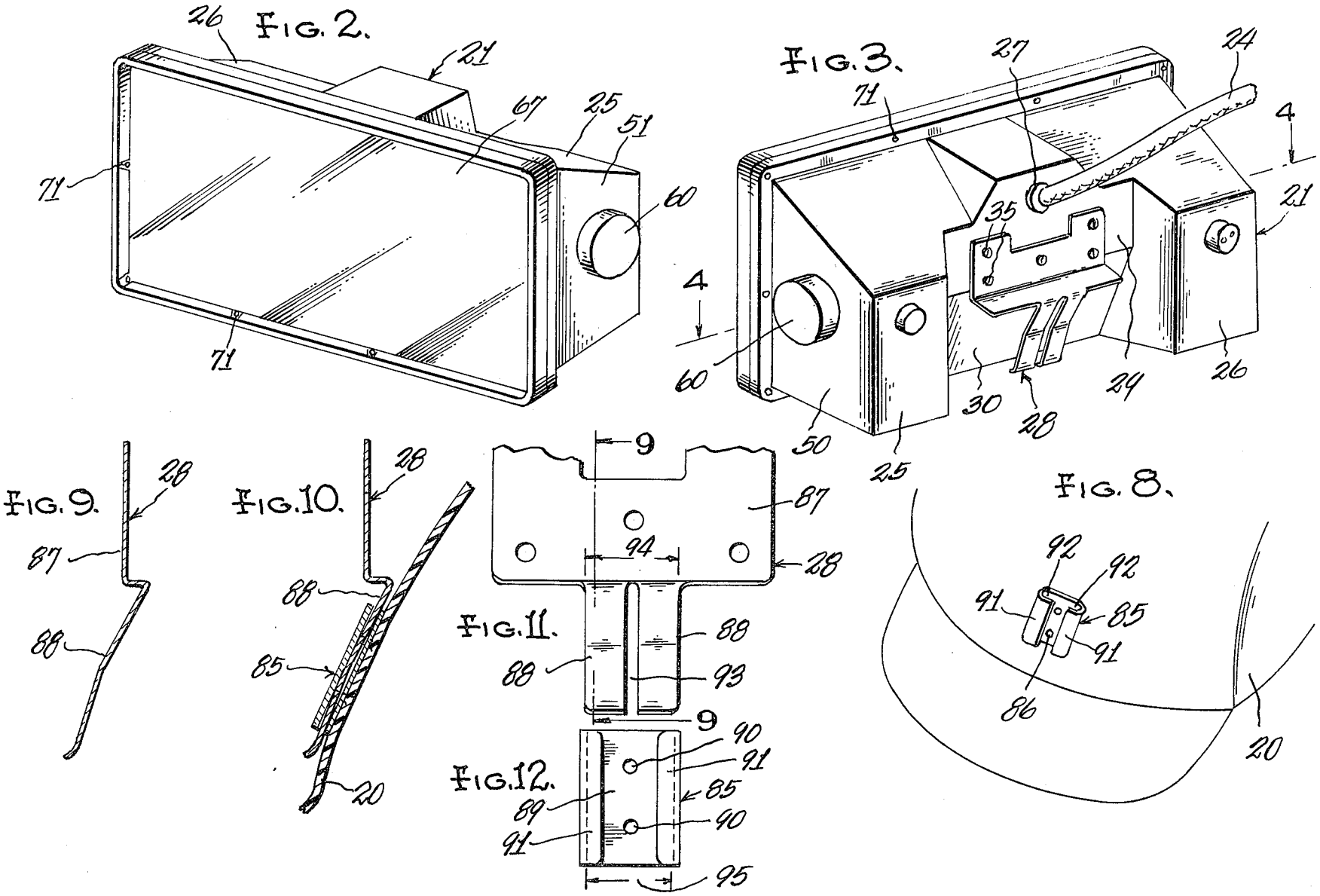
FIGS. 2 and 3 are small scale perspective views of the lamp, looking at the front and rear, respectively.
FIG. 8 is a fragmentary perspective view of a hard hat to which the lamp is connected.
FIG. 9 is an enlarged sectional view through a clip finger, corresponding to the line 9—9 of FIG. 11.
FIG. 10 is a view similar to FIG. 9 but showing the clip finger in assembled relation with a holder on the hard hat.
FIG. 11 is a fragmentary plan view of the clip connection.
FIG. 12 is a plan view of the clip holder.

As seen in the perspective views of FIGS. 2 and 3, the housing is preferably rectangular, as viewed from the front, and has enlarged side pockets 25,26 at the rear to house circuit components and connection wiring. The power cord 24 enters the rear of the housing at a central upper portion thereof, as seen at 27, and a clip connection 28, to be described in detail later, is connected to a central, inwardly recessed wall 29, the lower portion of which inclines forwardly, as seen at 30. The recessed wall 29 and rear side pockets enable the housing to engage the curved forward portion of the hard hat at three places to provide for stability of the assembly.

Figures 4, 5, 6, 7:
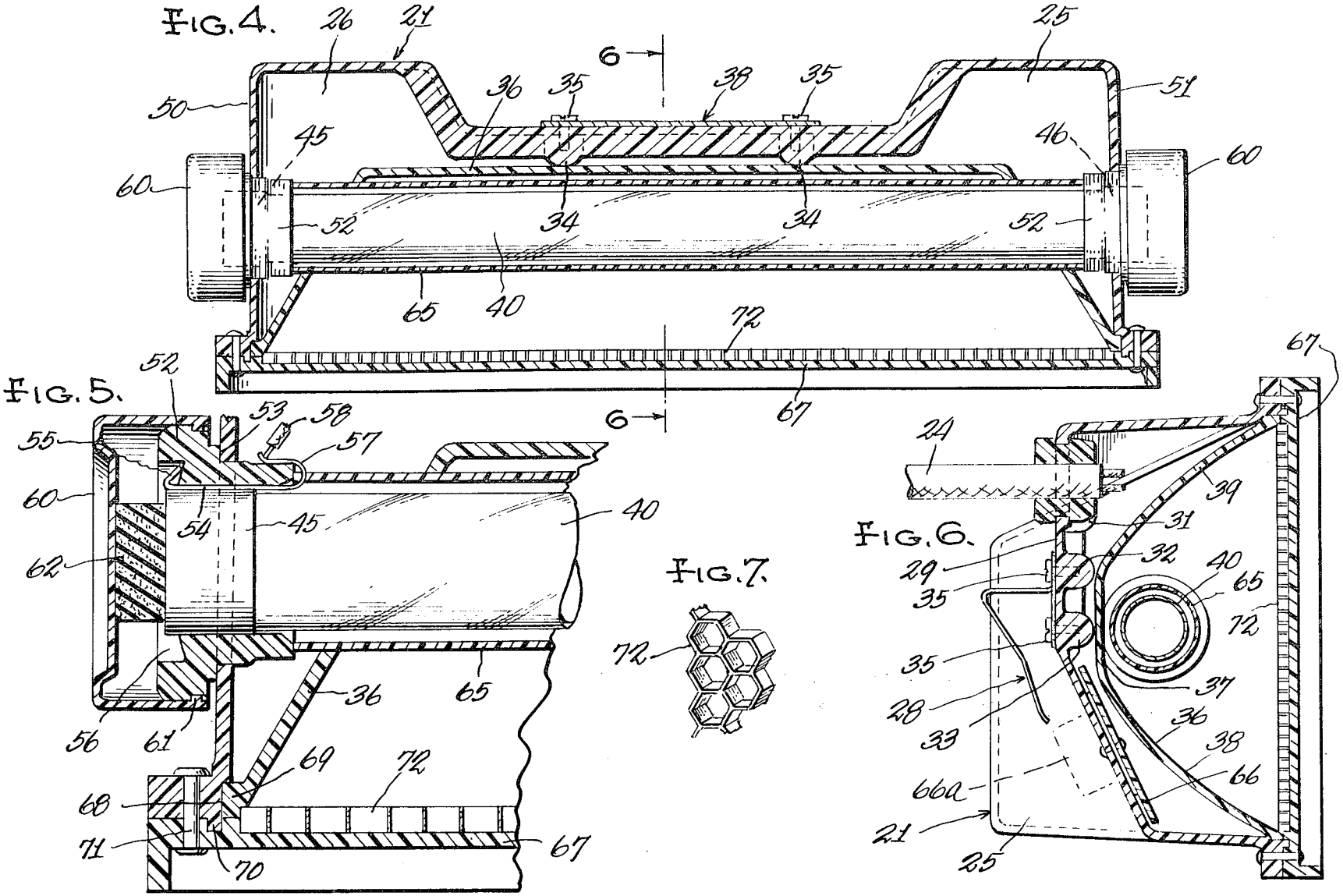
FIG. 4 is an enlarged, sectional view corresponding to the line 4—4 of FIG. 3.
FIG. 5 is an enlarged, fragmentary sectional view of one end portion of the construction shown in FIG. 4.
FIG. 6 is a transverse sectional view corresponding to the line 6—6 of FIG. 4.
FIG. 7 is a fragmentary perspective view of a detail.

As seen in FIGS. 4 and 6, three horizontal ribs 31,32 32 and 33 project forwardly from the inner surface of the wall 29, the ribs 32 and 33 having horizontally spaced nubs 34 to which are threaded screws 35 for holding the clip connection 28 to the housing. The nubs 34 on the lower rib 33 also provide locating means against which the rear surface of the reflector 36 abuts, as seen in FIG. 6. The reflector presently preferred is not parabolic in section, but rather has a fairly straight central portion 37 leading to oppositely outer curved portions 38,39.

The central section 37 of the reflector is disposed immediately behind a fluorescent tube 40 which, as seen in FIGS. 4 and 6, is a round, straight tube having a central active length and end portions 45,46 which constitute the opposite end terminals and which contain the ballast electrodes. As seen in FIG. 4, the reflector 36 reflects light emanating from the central active length of the tube, while the end portions 45,46 are contained within opaque end structures, so that the net effect is a smaller, lighter weight lamp assembly which offers a less bulky head gear and also has a better visual effect than a full width reflector.

As seen in FIG. 4, opposite end walls 50, 51 of the housing 21 are provided with openings to receive insulating bushings 52 which are similar in construction and which are preferably made of polycarbonate. Each bushing is of stepped cross section to provide a shoulder 53 which abuts the exterior surface of the respective end wall of the housing. Each bushing, in the area of the shoulder 53 is cemented or ultrasonically welded to the respective housing end walls 50,51. Opposite end terminals 45, 46 of the fluorescent lamp are seated within respective bushings 52. Electrical connector clips 54 have a central portion engageable with a respective end terminal (45 or 46) of the fluorescent tube. One end portion 55 of the connector clip is contained within an end recess 56 formed in a respective bushing 52, while the opposite end portion 57 is disposed within a pocket 25, or 26 of the housing, for connection to a circuit wire 58. An opaque, plastic cap 60 has its skirt portion attached to a respective bushing 52 to seal against entrance of any hazardous material, such as a methane gas in mines, from entering the housing. As seen in FIG. 5, the cap skirt portion has an annular rib 61 seating behind a shoulder on the bushing, and the cap is preferably cemented to the bushing to prevent unauthorized access to the housing interior in this area. In order to maintain the fluorescent tube in central position and to resiliently hold it against axial displacement, foam rubber spacers 62 are disposed between the opposite ends of the tube and the inner surface of a respective cap 60.

A characteristic of fluorescent lamps is that the light output reduces with declining temperatures. Thus, if the lamp is energized at a low temperature, for example 0°F, it is important to conserve every bit of heat generated within the lamp to raise its temperature as quickly as possible and thereby achieve a higher level of light output. We have solved this problem by disposing the fluorescent lamp 40 within a transparent plastic tube 65 which is only slightly larger in inside diameter than the external diameter of the fluorescent lamp. This creates a small volume of still air around the fluorescent tube to act as a thermal-insulation barrier which is transparent enough to transmit light outward with a minimum of absorption. A preferred plastic for the tube 65 is a cellulose acetate butgrate (CAB) because of its superior optical properties and relatively low cost. In areas where low temperatures are not encountered, the tube 65 may be omitted.

A support board 66, of electrical insulating material, is attached to the inclined wall 30, as by rivets or the like, as seen in FIG. 6. The support board 66 has opposite end portions extending into the pockets 25,26 of the housing, and circuit components **66*a***, such as a transistor, capacitor, resistors, inductor, and transformer, are mounted on such end portions, the pockets providing adequate space for the same.

A lens 67 closes the open front end of the housing 21 and is preferably of the same rectangular shape as such opening. The lens is made of plastic, such as polycarbonate plastic. As seen in FIG. 5, the housing at its front opening, is formed with a peripheral undercut to provide a recess 68, and a ribbed portion 69 of the reflector is seated in this recess. The housing 21 has a forwardly extending peripheral rib 70 which seats in a corresponding recess formed in the lens 67, and the housing lens and reflector are firmly held assembled in any suitable manner, such as by rivets 71, to prevent unauthorized entry into the housing in this area. The interfitting ribs and recesses provide a seal to restrict entrance of hazardous material, such as methane gas in mines, from entering the housing.

In some cases, glare from the light emanating from the fluorescent tube, may be objectionable, particularly to a person looking at the light from a side thereof. We have reduced this glare, with out materially obstructing transmission of light through the lens 67, by placing a thin section of aluminum honeycomb material 72 directly inside the lens, as seen in FIGS. 4, 5, and 6. FIG. 7 is a fragmentary perspective view showing a portion of this material and it may be held in place by cementing its peripheral edge to the inside surface of the lens, or may be held in any other suitable manner, such as by pinching a peripheral portion between the reflector and lens. It will be appreciated that the honeycomb construction will reduce light levels from oblique angles.

Another construction to reduce glare is shown in FIGS. 13 and 14 which are fragmentary reproductions of the lens area only of FIGS. 4 and 6. In this construction, the lens **67*a* is also preferably made of polycarbonate plastic, and is molded to provide a plurality of vertical ribs (three ribs being shown on opposite sides of a central rib). It will be noted that the lens 67*a* is thin and flat on opposite sides of the center rib 80 to the next adjacent ribs 81—81. Between ribs 81 and 82, the thickness of the lens tapers from a thicker portion at the rib 81 to a thinner portion at the rib 82. This varying thickness also exists between ribs 82 and 83, and between rib 83 and the end of the lens, with the thickness at the thicker portions gradually increasing, as seen in FIG. 13. If glare is not objectionable, the lens may be formed simply as a flat, thin, plane of plastic, such as it would be if the honeycomb material 72 where removed from FIGS. 4, 5 and 6**.

A portion of the hard hat 20 is shown in perspective in FIG. 8 and is disposed adjacent to FIG. 3 to illustrate a metal holder 85 which is attached to the front portion of the hat, as by rivets 86. The holder 85 is adapted to receive the clip connection 28 secured to the housing 21 to effect a detachable connection between the hat and housing. The connection is unique in that it restricts front-to-back movement of the housing relative to the hat, and also restricts side-to-side movement of the housing.

Referring particularly to FIGS. 9 through 12, the clip connection 28 is preferably formed as a stamping from sheet metal, preferably stainless steel that is spring tempered after the stamping and forming operations. The clip connection comprises a base plate 87 having holes to pass the screws 35 which hold it to the hard hat. A pair of fingers 88 extend downwardly from the base plate 87 and include portions that are angularly related, as seen in FIG. 9. The holder 85 may also be formed to stainless steel and comprises a flat body portion 89 having holes 90 to pass the rivets 86 which secure it to the front portion of the hard hat 20. Opposite sides of the body portion 89 are folded over, as shown at 91, to form receiving spaces 92 for receiving side portions of respective fingers 88.

Each space 92 is of a depth that is less than the angular relation of the finger portions so that when the fingers are pushed into the spaces, they tend to flatten the angularity of the portions, and this restricts front-to-back movement of the housing 21. As seen in FIG. 11, the fingers 88—88 are separated by a slot 93. The lateral dimension 94 of the fingers is slightly greater than the dimension 95 between opposed interior wall surfaces of the holder 85 so that when the fingers 88 are pushed into the spaces 92, the fingers are spring-pressed toward each other, and this restricts side-to-side movement of the housing 21.

We claim:

1. Illuminating apparatus, comprising:

an oblong housing having opposed end walls, an elongated fluorescent tube lamp within said housing and extending along the longer portion thereof, said opposed end walls of said housing having axially aligned openings therein, a tubular insulator bushing secured within each said opening and having end portions extending beyond inner and outer side surfaces of respective opposed end walls, opposite end portions of said lamp being disposed within respective bushings, said housing having end portions adjacent said opposed end walls and an intermediate portion, said end portions being enlarged relative to said portion intermediate said end portions thereby to form pockets, a circuit board within said housing and attached to a wall of said intermediate housing portion, opposite ends of said circuit board extending toward said pockets, and, electrical devices carried by said circuit board on at least one end thereof and disposed within the adjacent housing pocket.

2. The construction according to claim 1, and further including a cup-shaped metal terminal on each end of said lamp, and an electrical contact carried by each of said bushings and disposed between the interior surface, defining the bushing opening and the exterior surface of a respective lamp terminal and engageable with the latter, said contacts being adapted to be connected to a source of electrical current to supply current to said lamp.

3. The construction according to claim 1 wherein each bushing has a head portion bearing against the outer side surface of a respective housing end wall, and a cap member over and secured to each bushing head portion.

4. The construction according to claim 3 wherein opposite ends of said lamp are provided with cup-shaped metal terminals, and further including a resilient plug disposed between the inner surface of each cap member and the adjoining end of a respective lamp terminal to restrict axial movement of said lamp.

5. The construction according to claim 1 further including a transparent tube closely surrounding said fluorescent lamp to provide a generally closed air space therebetween to conserve heat generated by said lamp and improve light output at lower ambient temperatures.

6. The construction according to claim 1 further including a reflector having an elongated portion disposed behind said lamp and being transversely curved and terminating in angled end portions to provide an oblong peripheral edge surface of the same oblong shape as said housing.

* * * * *